United States Patent [19]

van Rijswijk

[11] Patent Number: 4,499,144

[45] Date of Patent: Feb. 12, 1985

[54] FLUID CONTAINING STRING WITH OPENING TO PASS FLUID FROM CORE

[75] Inventor: Jacob van Rijswijk, Berkel en Rodenrijs, Netherlands

[73] Assignee: Jacotra A. G., Switzerland

[21] Appl. No.: 457,523

[22] Filed: Jan. 13, 1983

Related U.S. Application Data

[63] Continuation-in-part of Ser. No. 257,103, Apr. 24, 1981, abandoned.

[30] Foreign Application Priority Data

Apr. 28, 1980 [GB] United Kingdom ..... 8013945

[51] Int. Cl.[3] ..... D07B 1/02

[52] U.S. Cl. ..... 428/376; 273/29 R; 273/29 A; 273/73 R; 428/377; 428/394; 428/398; 428/399; 428/400; 57/232

[58] Field of Search ..... 428/376, 377, 394, 398, 428/399, 400; 57/140 C, 149, 153; 273/29 R, 29 A, 73 R

[56] References Cited

U.S. PATENT DOCUMENTS 1,991,893 2/1935 Flick et al. ..... 428/376

*Primary Examiner*—Marion E. McCamish

*Attorney, Agent, or Firm*—Kane, Dalsimer, Kane, Sullivan and Kurucz

[57] ABSTRACT

This invention relates to a string for sports rackets which comprises a core (1), the core being constituted by one or more synthetic polymeric monofilaments, the, or at least one of the monofilaments having a longitudinal bore (2), and, along the length of the bore, one or more openings (3) for the passage of fluid from the bore, the core being covered by a wrapping (9,10) of synthetic polymeric material (FIGS. 7 and 8).

22 Claims, 10 Drawing Figures

FLUID CONTAINING STRING WITH OPENING TO PASS FLUID FROM CORE

This is a continuation-in-part to application Ser. No. 257,103 filed on Apr. 24, 1981 now abandoned.

This invention relates to a string made of synthetic polymeric material and especially to a string for use in stringing sports rackets, for example badminton, squash, or tennis rackets.

British Patent Specification No. 1228171, to which attention is directed, describes a string construction comprising a core consisting of at least one monofilament of a synthetic polymeric material and at least one helical wrapping of a synthetic polymeric material, a lubricant being contained in the core and/or between the wrapping and the core.

The lubricant is usually introduced by injecting it into the core, either into a bore in each monofilament of the core or into the spaces between those monofilaments. After the string has been manufactured the lubricant in the core diffuses through the wrapping so that too is lubricated. Complete impregnation of the string may not be possible if the said bore(s) and/or space(s) are too small and/or if the quantity of lubricant injected into the core is not sufficient and, in any case, dispersion of the lubricant throughout the string can take several weeks.

The lubricant plasticises the string, renders it more pliable and resists penetration of moisture. Consequently, the life-time of the string is increases and its playing characteristics improved.

The present invention seeks to overcome these problems and to provide a string which is quickly and completely impregnated with lubricant.

The present invention provides a string for sports rackets which comprises a core, the core being constituted by one or more synthetic polymeric monofilaments, the, or at least one of the monofilaments having a longitudinal bore, and, along the length of the bore, one or more openings for the passage of fluid from the bore, the core being covered by a wrapping of synthetic polymeric material.

With this string construction fluid injected into the or each monofilament bore can pass through the opening or openings and disperse rapidly to the outside.

The fluid is chosen to improve one or more of the following properties of the string: its playing characteristics, its pliability or suppleness, its resistance to ingress of moisture, and its tensile strength. The fluid is, with advantage, a lubricant, oil, grease, wax or fat (hereinafter referred to generally as a lubricant).

The opening or openings can be of any suitable form as long as their total cross-sectional area is not such that the strength of the string is unduly weakened. For example, the wall of the or each monofilament bore can be provided with a number of perforations (which may be in the form of slits or slots) along its length but it is preferred, for simplicity of manufacture, if a single slit is provided along its length.

Although the core may comprise two or more monofilaments—which may be longitudinally aligned or twisted or plaited together—it is preferred if the core is formed by a single monofilament.

Advantageously, the outer surface of the core is coated with a fluid(preferably a lubricant)-absorbing material. This material, which may be applied by an electrostatic process, for example by electrostatic spraying, may be in the form of a fine powder or dust, for example cotton or flock. The coating material serves not only to absorb the fluid escaping through the opening(s) in the core but also to allow the fluid to permeate completely round the outer surface of the core.

Further to improve dispersion of the fluid round the core and into the wrapping it is of advantage if a thread or yarn of material, for example cotton, is wound, preferably helically, round the core. In this way, fluid from the opening(s) is absorbed by the thread and passed round the core and into the wrapping.

Although the thread may be provided between the core and the wrapping, it is preferred if it forms part of the wrapping itself.

The wrapping can be formed in any way as long as it allows dispersion of the fluid, for example, it can be in the form of a tube or sheath of synthetic polymeric material. It is, however, preferably filamentary in form and may be applied as a ribbon of filaments which may be twisted, plaited, braided or woven together or arranged in side-by-side relationship. This construction facilitates the provision of the thread as part of the wrapping since it can form one of the filaments of that wrapping.

If two or more wrappings are provided on the core, then the outer surface of the inner of two adjacent wrappings can be provided with a coating of fluid (preferably lubricant) absorbing material and/or with a wound thread or yarn in the same way as the core. In this way, dispersion of the fluid round the inner wrapping and into the outer wrapping is promoted.

Preferably, the or each wrapping is helically wound round the core, and, in the case of two or more wrappings, adjacent wrappings are preferably wound in opposite senses.

The present invention also provides a string for sports rackets which is constituted by two or more synthetic polymeric monofilaments which are twisted or plaited together, wherein at least one of the monofilaments is provided with a longitudinal bore, and, along the length of the bore, with one or more openings for the passage of fluid from the bore.

Preferably, the opening in the wall of the or each monofilament bore is in the form of a single slit provided along its length.

The present invention also provides a string constructed in accordance with the invention, the string having been impregnated with a lubricant or suitable fluid material.

The present invention further provides a sports racket having a string constructed in accordance with the invention.

The present invention further provides a method comprising the step of injecting lubricant or other suitable fluid into the bore of the or each monofilament of a string constructed in accordance with the invention.

Before injecting the fluid the string may be treated, for example, by subjecting it to a sub-atmospheric pressure and/or exposing it to a low humidity atmosphere, to remove air and/or moisture. This treatment will facilitate dispersion of the fluid through the string when it is subsequently injected.

The fluid may also be heated prior to injection. Further, if the fluid is solid or gel-like under normal conditions, for example if it is a lubricant in the form of a wax or fat it may have to be heated to render it sufficiently fluid for injection purposes.

The fluid may be injected into one end of the bore under a relatively high pressure preferably while having a reduced pressure at the other end of the bore.

The string may be fully impregnated with fluid merely by injecting the fluid into the or each monofilament bore. To accelerate impregnation, however, the method may include the further step of closing the ends of the bore, when filled with fluid, for example by plugging, and then immersing the string in a bath of the fluid. In this way the outer surface of the string is wetted with fluid and, as a result, the fluid can disperse into the string from outside to inside.

Preferably, the fluid is forced through the string from outside to inside under pressure.

The present invention also provides a method comprising the steps of immersing a string constructed in accordance with the invention (and having no fluid in it) in a bath of fluid and forcing the fluid through the string from outside to inside under pressure.

For example, the string may be immersed in fluid in a pressure tank and subjected to a pressure of up to 120 atmospheres and preferably up to 80 atmospheres.

Preferably the fluid is heated above ambient temperature, for example in the case of a lubricant it can be heated to a temperature of 80° C. to 100° C. but is preferably heated to a temperature of between 40° C. and 50° C. Heating the fluid facilitates its dispersion through the string. The temperature to which the fluid is heated should not, however, be such as to adversely affect the structure of the string, e.g. its molecular structure, its firmness or its solidity.

Subjecting the string to pressure and/or heat treatment as referred to above has the additional and unexpected advantage of allowing the string, when used in a racket, to be put under higher tension without adversely affecting its elasticity. Consequently, the playing characteristics of the string are improved.

It may be necessary, in at least some cases, to provide a bond between the core and its wrapping and/or between adjacent wrappings. Any bonding process may be used as long as fluid dispersion through the string is not prevented. For example, an adhesive coating of the type disclosed in British Patent Specification No: 1228171 may be used. A lubricant will, in fact, disperse through such an adhesive coating and into the outer wrapping(s). Further, to promote dispersion of the fluid through the coating, however, the adhesive may be mixed with a fluid (preferably a lubricant) absorbing material (which may be a fine dust or powder, for example cotton or flock). Because the adhesive is applied in the form of a thin coating or film the absorbing material will extend or break through, and allow transmission of fluid through the film.

Alternatively, the string may be subjected to steam to effect bonding between the core and the wrapping and/or between adjacent wrappings. Such a process is described in British Patent Specification No. 1045576.

The present invention also provides a string for sports rackets which comprises a core, the core being constituted by one or more synthetic polymeric monofilaments, the, or at least one of the monofilaments having a longitudinal bore, the wall defining the bore having one or more regions of reduced thickness, the or each of which regions is frangible to allow passage of fluid from the bore, the core being covered by a wrapping of synthetic polymeric material.

This construction completely eliminates the possibility of the aforesaid fluid opening(s) being blocked or clogged with adhesive during bonding of the wrapping to the core (which may, subsequently, at least partially prevent flow of fluid out of the bore in the or each core monofilament), because no opening is formed until the frangible region(s) is broken. The frangible region(s) may be broken, after formation and before fluid impregnation of the string (during formation the core monofilament is kept straight) by bending or twisting the string (for example by winding it into a roll) and/or by the pressure of the fluid subsequently introduced into the core monofilament(s).

The or each frangible region may be formed at the outer surface of the monofilament and may at least partially close a respective opening formed in the wall of the monofilament and leading to the bore.

The or each frangible region may result, at least in part, by having different cross-sectional shapes for the inner and outer surfaces of the monofilament wall and/or by eccentric positioning of the bore within the monofilament.

The present invention further provides a method of forming a string constructed in accordance with the present invention, the method comprising the step of inserting a cutting tool having a radially extending blade into a longitudinal bore of a synthetic polymeric monofilament and forcing the tool along the length of the bore so that the blade cuts a longitudinal slit in the monofilament.

Alternatively, the slit can be formed during extrusion of the monofilament itself by using a suitable extrusion die orifice.

Strings constructed in accordance with the present invention and a method of impregnating those strings will now be described, by way of example only, with reference to the accompanying drawings, in which.

Figure 1:
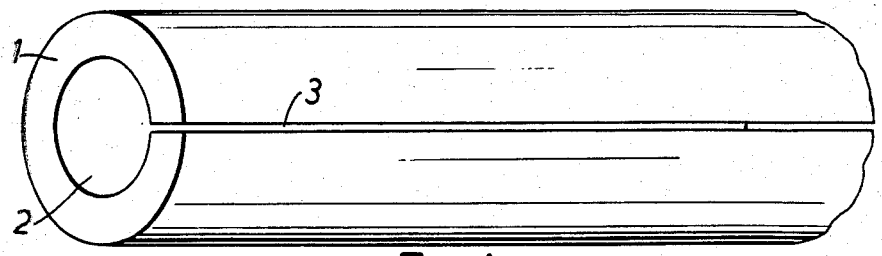
FIG. 1 shows part of a core of a first string.

Referring to the accompanying drawings, FIG. 1 shows a synthetic polymeric monofilament 1 which forms the core of a string, the monofilament being formed by extrusion. The monofilament has a bore 2 formed during extrusion and a longitudinally extending slit 3.

Figure 2:
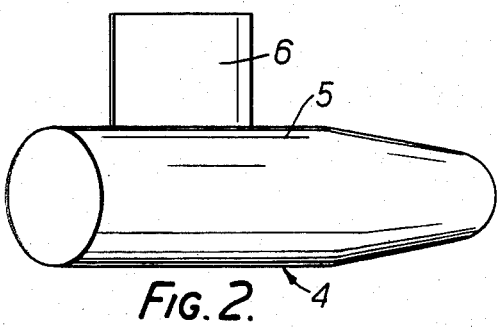
FIG. 2 illustrates a cutting tool for cutting the slit in the core of FIG. 1.
Figure 3:
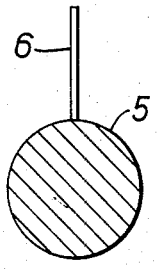
FIG. 3 is a cross-section through the cutting tool shown in FIG. 2.
Figure 4:
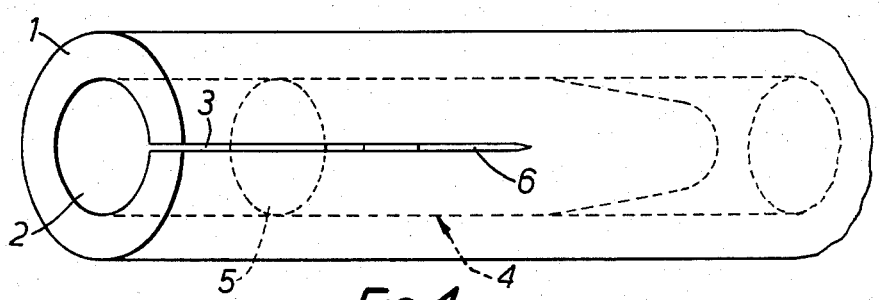
FIG. 4 illustrates how the cutting tool in FIGS. 2 and 3 is used to cut the slit in the core.

A cutting tool 4 is shown in FIGS. 2 and 3 and comprises a steel pin 5 provided with a radially extending cutting blade 6. As shown in FIG. 4, the pin is inserted into the bore 2 of the core monofilament 1 and is forced along the bore 2 so that the cutting blade 6 cuts into the wall of the monofilament 1 to form the slit 3. Alternatively, the slit 3 can be formed during extrusion of the monofilament itself.

Figure 5:
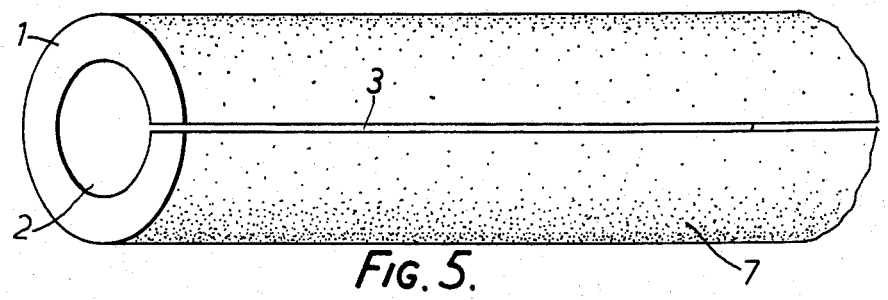
FIGS. 5 to 7 show various stages in the formation of the string.

When the slit has been formed in the core monofilament the outer surface of the monofilament core is coated with a lubricant-absorbing material. This material, which may be applied by an electrostatic process, for example by electrostatic spraying, may be in the form of a fine powder or dust 7, for example cotton or flock (FIG. 5).

Figure 6:
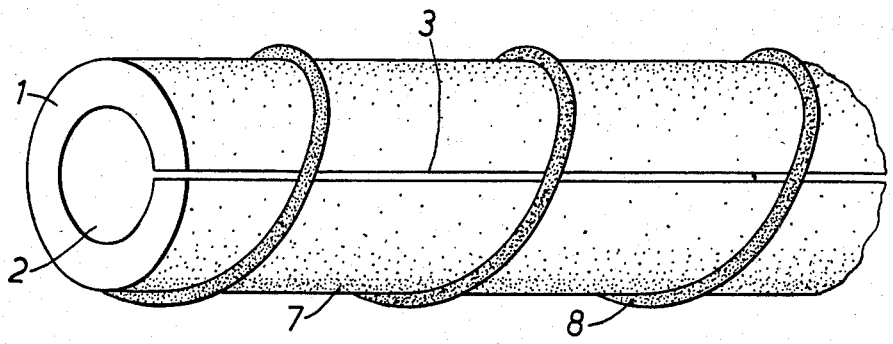

At this stage in the manufacture of the string a thread or yarn 8 of material, for example cotton, is helically wound round the core monofilament 1 as shown in FIG. 6.

Around the core 1 are helically wound a plurality of wrapping monofilaments 9 also of synthetic polymeric material. These wrapping monofilaments are of small diameter compared to the diameter of the core monofilament. As shown at the left hand side of FIG. 7, the diameter of the wrapping monofilaments is approximately the same as the diameter of the thread 8 and the thread, in fact forms part of the wrapping and can be wound simultaneously therewith.

Figure 8:
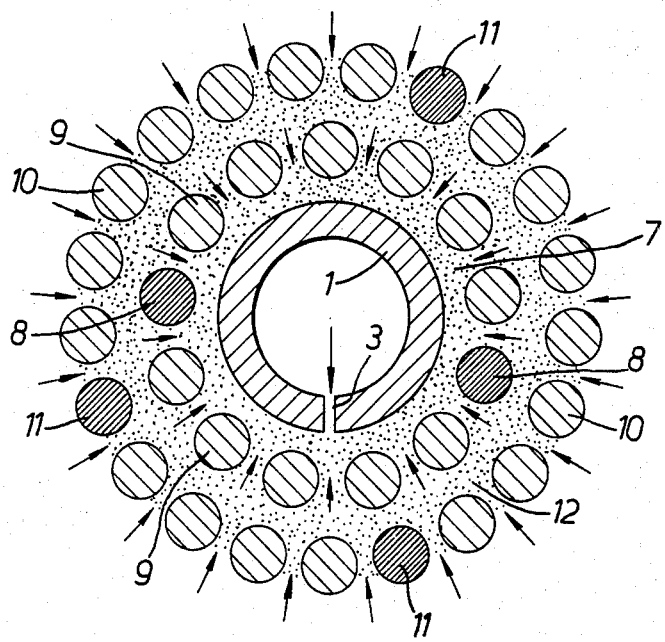
FIG. 8 is a cross-section through the completed string.
Figure 7:
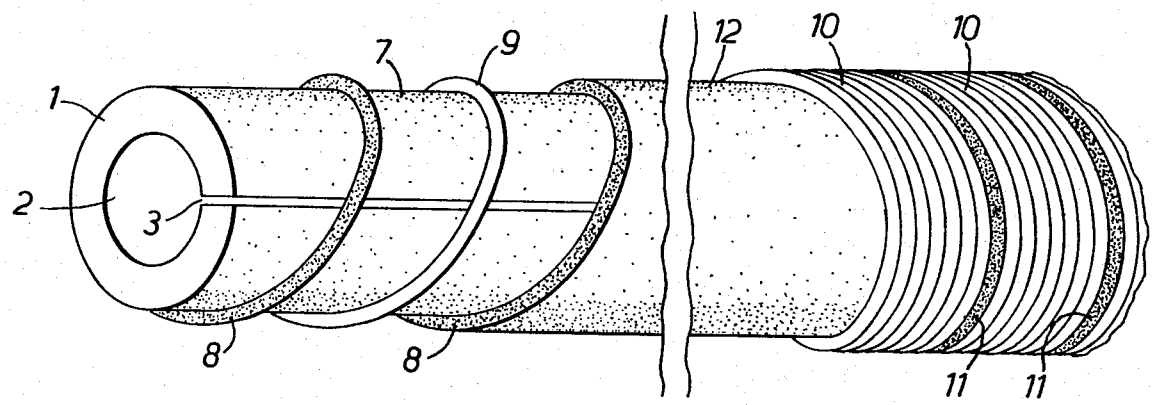

The string could in fact be formed with a single outer wrapping, but as shown at the right hand side of FIG. 7 and in FIG. 8 further to increase the strength and/or the stiffness of the string a second wrapping of polymeric monofilaments 10 is helically wound around the monofilaments 9; the wrapping 10 being wound in the opposite sense to the wrapping 9.

Again, it will be seen from FIG. 7 that the outer wrapping of monofilaments 10 comprises a yarn or thread 11 which is also helically wound round the inner wrapping of monofilaments 9.

Prior to applying the outer wrapping of monofilaments 10 the outer surface of the inner wrapping of monofilaments 9 is coated with a fine powder or dust 12 similar to the coating 7 described above.

Suitable materials for both the core monofilament and the wrapping monofilaments are, for example, polyamides, for example, nylon or polyesters, for example, polyethylene terephthalate. The material of the core may be the same as or different from the material of the wrapping.

To impregnate the string with lubricant, the lubricant is first injected into the bore of the core monofilament 1. This can be done by injecting the lubricant into one end of the bore under relatively high pressure while having a reduced pressure at the other end of the bore. As the lubricant is injected under pressure, it will pass out (in the direction of the arrow) through the slit 3 and into the two outer wrappings. Dispersion of the lubricant is facilitated by the coatings 7 and 12 and also by the threads 8 and 11.

To ensure that the string is fully impregnated with lubricant the string, after the ends of the core monofilament have been closed for example by plugging, is inserted into a pressure-tank (not shown) filled with lubricant. The string could also be inserted into the tank without prior filling of the core monofilament with lubricant. In that case the ends of the core monofilament can be closed after the string has been fully impregnated with lubricant. The pressure within the tank is increased up to 80 atmospheres and this forces the lubricant through the outer wrapping 10 towards the core 1 in the direction of the arrows. To assist the inward flow of lubricant, the lubricant may be heated to a temperature of up to 80° C. to 100° C., but is preferably heated to a temperature of between 40° C. and 50° C.

Figure 9:
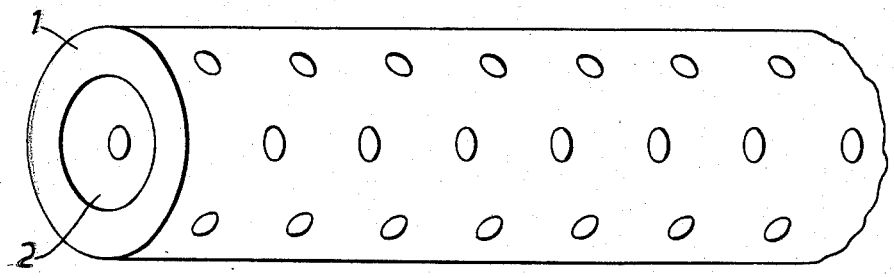
FIG. 9 shows part of an alternative core construction.

Instead of forming the core monofilament 1 with a slit 3 it could be formed with a plurality of holes or perforations (preferably radially extending) as shown in FIG. 9. Such a core monofilament could, of course, be used in the string construction shown in FIGS. 7 and 8. The holes or perforations could also be in the form of small slots.

At least part of the slot 3 or each of at least some of the openings of the FIG. 9 construction may be incompletely formed, it being at least partially closed at the outer surface of the monofilament by a frangible covering of polymeric material.

Alternatively the slot or openings may be completely replaced by forming one or more regions of the monofilament wall with a reduced thickness, the or each region being frangible to allow passage of fluid from the bore. Such frangible regions may be obtained by having different cross-sectional shapes for the inner and outer surfaces of the monofilament wall (e.g. the bore may be triangular or polygonal in shape) and/or by eccentrically positioning the bore within the monofilament.

Figure 10:
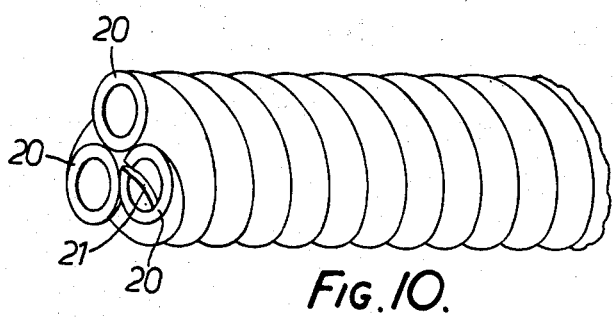
FIG. 10 shows a second string construction.

A different string construction is shown in FIG. 10. In this case, the string comprises three (it could be two or four or more) synthetic polymeric monofilaments 20 which are twisted or plaited together. At least one (all of them could be) of the monofilaments has a longitudinal slit 21 (alternatively it could be formed with the perforations as shown in FIG. 9). This string can be fluid impregnated in the same way as described above. This construction could also be used as a core of a string to replace, for example, the monofilament core of the string shown in FIGS. 7 and 8.

The lubricant may be any oleaginous material which does not adversely affect the properties of the material or materials from which the string is made. Preferably the lubricant is a mineral oil, for example petroleum (which may be liquid) or grease, for example, paraffin wax, liquid paraffin or a vegatable oil or grease, for example soy bean oil, habassu oil, palm kernal oil, palm oil, olive oil, coconut oil, castor oil, peanut oil or rape oil.

The lubricant may also be such that it solidifies or gels (that is to say, it has a relatively high viscosity)—rather than remaining in its liquid state (with a relatively low viscosity)—after application to the string. For example, the lubricant can be rendered liquid by heating (above, for example, room temperature) and applied to the string while in that form, and then allowed to cool (back to room temperature).

The lubricant can, in this case, be, for example, a wax, a grease, a fat such as an animal (for example, sheep) or vegetable oil, or petrolatum, or a cyclic hydrocarbon (equivalent to $C_nH_{2n}$-2).

Impregnation of the string with a lubricant as described above not only improves its playing characteristics, its pliability, its moisture repellancy and its tensile strength but also facilitates stringing of sports rackets.

In summary, the present invention pertains to a string for sports rackets comprising a core surrounded by a wrapping. The core is adapted to be filled with a lubricant to improve the physical characteristics of the string. To this end the core comprises one or more monofilaments at least one of which has a longitudinal bore in which the lubricant is introduced, and one or more openings or frangible regions along the length of the bore are provided to allow the lubricant to diffuse to the wrapping. The wrapping may comprise one or more filaments wound, preferably helically, around the core. To enhance the effects of the lubricant on the string, the string may but does not have to include at least one filament which is made of a lubricant-absorbent material. That filament is wound round the core and preferably forms one of the filaments of the wrapping. Further-more, the core and/or the wrapping may but do not have to be coated with a fine powder or dust which is also lubricant-absorbent.

The core of the string may be formed by a single monofilament or it may comprise two or more monofilaments which may be twisted or plaited together. Further, two or more monofilaments, which are twisted or plaited together, can themselves form a further string construction of the invention which has no wrapping.

What I claim is:

1. A string for sports rackets which comprises a core, the core being constituted by one or more synthetic polymeric monofilaments, the, or at least one of the monofilaments having a longitudinal bore, and, along the length of the bore, one or more openings for the passage of fluid from the bore, the core being covered by at least one wrapping of synthetic polymeric material.

2. A string for sports rackets which comprises a core, the core being constituted by one or more synthetic polymeric monofilaments, the, or at least one of the monofilaments having a longitudinal bore, the wall defining the bore having one or more regions of reduced thickness, the or each of which regions is frangible to allow passage of fluid from the bore, the core being covered by at least one wrapping of synthetic polymeric material.

3. A string for sports rackets which comprises a core, the core being constituted by one or more synthetic polymeric monofilaments, the, or at least one of the monofilaments having a longitudinal bore, the wall defining the bore having one or more regions of reduced thickness, the or each of which regions is frangible to allow passage of fluid from the bore, the core being covered by at least one wrapping of synthetic polymeric material and a fluid absorbing means provided outside the core for promoting dispersion of the fluid from the core to the wrapping.

4. A string as claimed in claim 3, in which the or each frangible region is formed at the outer surface of the monofilament and at least partially closes a respective opening formed in the wall of the monofilament and leading to the bore.

5. A string as claimed in claim 3, in which the or each frangible region results, at least in part, by having different cross-sectional shapes for the inner and outer surfaces of the monofilament wall.

6. A string as claimed in claim 2, in which the or each frangible region results, at least in part, by eccentric positioning of the bore within the monofilament.

7. A string for sports rackets which comprises a core, the core being constituted by one or more synthetic polymeric monofilaments, the, or at least one of the monofilaments having a longitudinal bore, and, along the length of the bore, one or more openings for the passage of fluid from the bore, the core being covered by at least one wrapping of synthetic polymeric material and a fluid absorbing means provided outside the core for promoting dispersion of the fluid from the core to the wrapping.

8. A string as claimed in claim 1, in which the opening in the wall of the or each monofilament bore is in the form of a single slit provided along its length.

9. A string as claimed in claim 1, in which the core is formed by a single monofilament.

10. A string as claimed in claim 1, in which the or each wrapping is filamentary in form.

11. A string as claimed in claim 1, in which two or more wrappings are provided on the core.

12. A string as claimed in claim 1, in which the outer surface of the core and/or the outer surface of the inner of two adjacent wrappings is coated with the fluid-absorbing material.

13. A string as claimed in claim 12, in which the material is a fine powder or dust.

14. A string as claimed in claim 1, in which said means comprises a thread or yarn of fluid-absorbing material is wound round the core and/or round the outer surface of the inner of two adjacent wrappings.

15. A string as claimed in claim 14, in which the thread or yarn is helically wound.

16. A string as claimed in claim 14, in which the thread or yarn forms part of a respective wrapping.

17. A string as claimed in claim 1, in which the or each wrapping is helically wound round the core, and, in the case of two or more wrappings adjacent wrappings are wound in opposite senses.

18. A string as claimed in claim 1, the string having been impregnated with a lubricant or other suitable fluid.

19. A string for sports rackets which is constituted by two or more synthetic polymeric monofilaments which are twisted or plaited together, wherein at least one of the monofilaments is provided with a longitudinal bore, and, along the length of the bore, with one or more openings for the passage of fluid from the bore.

20. A string for sports rackets which is constituted by two or more synthetic polymeric monofilaments which are twisted or plaited together, wherein at least one of the monofilaments is provided with a longitudinal bore, and, along the length of the bore, with one or more openings for the passage of fluid from the bore a fluid absorbing means being provided outside the filaments to promote the dispersion of said fluid.

21. A string as claimed in claim 19, in which the openings in the wall of the or each monofilament bore is in the form of a single slit provided along its length.

22. A string as claimed in claim 19, the string having been impregnated with a lubricant or other suitable fluid.

* * * * *